US005226212A

United States Patent [19]

Beringer

[11] Patent Number: 5,226,212

[45] Date of Patent: Jul. 13, 1993

[54] FEED CONTROL APPARATUS FOR TEXTILE MACHINERY

[75] Inventor: Roland Beringer, Goldau, Switzerland

[73] Assignee: Maschinenfabrik Rieter AG, Winterthur, Switzerland

[21] Appl. No.: 655,294

[22] Filed: Feb. 12, 1991

[30] Foreign Application Priority Data

Feb. 21, 1990 [CH] Switzerland ..... 00557/90

[51] Int. Cl.[5] ..... D01B 3/04

[52] U.S. Cl. ..... 19/65 A; 19/236; 19/105

[58] Field of Search ..... 19/65 R, 65 A, 150, 19/157, 159 R, 159 A, 236, 105; 364/470; 414/357, 340, 373

[56] References Cited

U.S. PATENT DOCUMENTS

| | | | |
|---|---|---|---|
| 3,698,041 | 10/1972 | Hertzsch | 19/159 A |
| 3,884,026 | 5/1975 | Yoshizawa et al. | 19/159 A |
| 4,561,151 | 12/1985 | Schöpwinkel | 19/159 R |
| 4,577,372 | 3/1986 | Roder | 19/159 A |
| 4,688,300 | 8/1987 | Langen et al. | 19/159 A |
| 4,735,040 | 4/1988 | Pircher | 19/159 A |
| 4,930,190 | 6/1990 | Leifeld | 19/105 |
| 4,987,649 | 1/1991 | Meyer et al. | 19/159 A |
| 4,996,748 | 3/1991 | Jornot | 19/157 |
| 5,052,080 | 10/1991 | Gründler | 19/105 |
| 5,067,202 | 11/1991 | Demuth | 19/65 A |

FOREIGN PATENT DOCUMENTS

| | | | |
|---|---|---|---|
| 318144 | 5/1989 | European Pat. Off. . | |
| 367211 | 5/1990 | European Pat. Off. | 19/157 |
| 2912777 | 10/1979 | Fed. Rep. of Germany | 19/159 R |
| 3926036 | 2/1990 | Fed. Rep. of Germany . | |
| 2143229 | 2/1973 | France . | |
| 2534600 | 4/1984 | France . | |
| 2587042 | 3/1987 | France . | |

*Primary Examiner*—Clifford D. Crowder
*Assistant Examiner*—Michael A. Neas
*Attorney, Agent, or Firm*—Dority & Manning

[57] ABSTRACT

A textile machine for processing textile material is provided having a control and drive unit and a feeding device for feeding textile material drawn from storage means allocated to the feeding device. The textile machine further includes a delivery device for delivering drawn-off textile material to a receiving container. The feeding device of the machine has an independent feed control unit associated therewith for independently controlling the operation of the feed apparatus in a non-dependent relationship with the processing machine control unit. With this arrangement, a continuous supply of textile material is supplied to the processing machine without the feed device control unit being dependent upon external commands. The feeding device control unit is completely responsible for the initiation and operation of the continuous textile material feeding process.

24 Claims, 3 Drawing Sheets

FEED CONTROL APPARATUS FOR TEXTILE MACHINERY

The invention relates to a textile machine, particularly a feed control device for a textile machine.

In spinning mills various textile machines are used depending on the processing stage. A common feature of such various machines are the feeding and delivery devices for the textile material to be processed.

Essentially, the feeding and delivery devices in such machines, both with regard to control and drive, are fully integrated in the textile processing machine.

Present drive technology, in particular individual drive via electric motors, allows a finely tuned and controlled drive, whereby the communication with individual groups of drives may be performed without any problems and hardly any losses.

From the DE-OS 22 30 069 a textile processing machine is known which delivers the textile material, in this case a sliver, to a can pressing device having an own drive. In this system differences between the speed of the delivery of the sliver and the subsequent can pressing device are sensed by a sensing device and the drive of the can pressing device is controlled in accordance with the values thus determined. The control of both the can pressing device and the textile processing machine is performed by a central master computer.

Such a system is, however, not easily transferable to the feeding of textile material by means of a feeding device for a textile processing machine. With regard to an automated spinning mill, the feeding device has to fulfill additional requirements which the above mentioned state of the art of a delivery device does not include. Thus, for example, it is demanded that a feeding device may also be started up independent of the subsequent textile processing machine. This is particularly necessary when a new batch of textile material is to be prepared and has to be positioned for delivery to the textile processing machine. This is particularly the case when a part of the prepared textile material is held in a waiting position as reserve material.

The further known DE-AS 22 30 644 discloses a feed lattice for a textile processing machine, whereby the control or the switching on of calender devices for slivers is performed by means of electromagnetic couplings. In this system two pairs of pressure rollers are provided with control elements which switch on the reserve belt, said belt being in the waiting position, upon failure of the work belt. The drive of the conveying rollers and conveyor belt for feeding the slivers is connected with the drive of the subsequent textile processing machine both mechanically and with regard to the controls.

It is the object of the present invention to arrange the drive and control concept for a feeding device to a textile processing machine in such a manner that the special requirements for such a feeding device are fulfilled under the aspect of automation.

Automation comprises, on the one hand, the automatic supply of textile material without stopping the textile machine and, on the other hand, the connection with an automatic conveying system for the textile material.

This task is solved in accordance with the invention in that the feeding device is at least partially provided with an independent control and drive unit. For the communication between the control unit of the textile processing machine and the control unit of the feeding device it is further proposed that said two control units are connected via a connecting path.

For the purpose of further adapting to the special requirements of an interface of a conveying system allocated to a textile processing machine it is further proposed to also provide the delivery device with an independent control and drive unit, whereby said drive and control unit may also be connected with the control unit of the textile processing machine.

In order to enable a precise co-operation between the feeding device and an automatic conveying system allocated to said feeding device it is advantageous to connect the control unit of the feeding device and/or delivery device with the control unit for the automatic conveying system.

It is advantageous, and therefore further proposed, to provide the textile material storage means allocated to said feeding device and/or said delivery device with a sensing device for supervising the storage capacity and/or the content of said storage means, whereby the respective sensing device is connected with the respective control unit.

If the textile material storage means are cans, it is possible to arrange the sensing devices in such a manner that the one of said sensing devices checks the presence of a can and the other of said sensing devices checks the level of said can. For the purpose of achieving a precise control and a clearly structured drive concept, it is hereby proposed that the control unit of the feeding device should be connected with an operating and/or display unit, an electronic control means for controlling at least one motor for driving conveying elements, said elements conveying textile material taken from the respective textile material storage means, and with a sensing device for supervising the feeding device, in particular for supervising the conveyance of the textile material.

If slivers are supplied to a textile processing machine, e.g. to a drafting frame, the conveyance of the individual slivers on several revolving conveyor belts, said conveyor belts being supported from the ground, allows the feeding of the individual slivers to be precisely controlled. Preferably, each conveyor belt is provided with a separate drive motor.

The use of electric stepper motors in such a system allows the precise definition of the sliver's position during the whole conveying process, e.g. the beginning section of a subsequently supplied sliver, with regard to the conveying direction. The further proposed use of electronically commutated brushless motors, e.g. D.C. motors, has the advantage that the drive of the conveyor belt is able to work in the overload area for short periods of time without any problems.

In order to guarantee the efficiency of the textile processing machine with regard to the feeding speed of the supplied textile material, it is hereby proposed to provide a connecting path for transmitting guiding signals between the control unit of the textile processing machine and the electronic control means of the drive motors.

The thus transmitted guiding signals ensure the synchronization between the feeding device and the processing device of the textile processing machine, e.g. a drafting device. The processing speed of the textile processing machine changes in accordance with the mass of the textile material fed. In this event, the resulting mass is determined by, for example, an intake measuring organ in front of the drafting device, and thereupon a respective signal is transmitted to a control means.

In order to prevent a wrong draft of the textile material between the feeding device and the processing device, it is absolutely necessary to synchronize these two elements.

In order to prevent a build-up of the whole system during short periods of malfunction, it is hereby proposed to include an absorptive attenuator means in the connecting path for filtering out such signals.

The teaching claimed by the invention results in allowing the system to be excellently controlled by direct controlling. Furthermore, due to the independent drive, the distances for the drive are made shorter and consequently losses are reduced. Additionally, the drives may be designed specifically for individual applications due to its modular design. The proposed separation of the control and drive means allows a better coordination and communication to a provided automatic conveying means for the textile material.

Further advantages are described below by way of example and with reference to the accompanying drawings in which.

Figure 1:
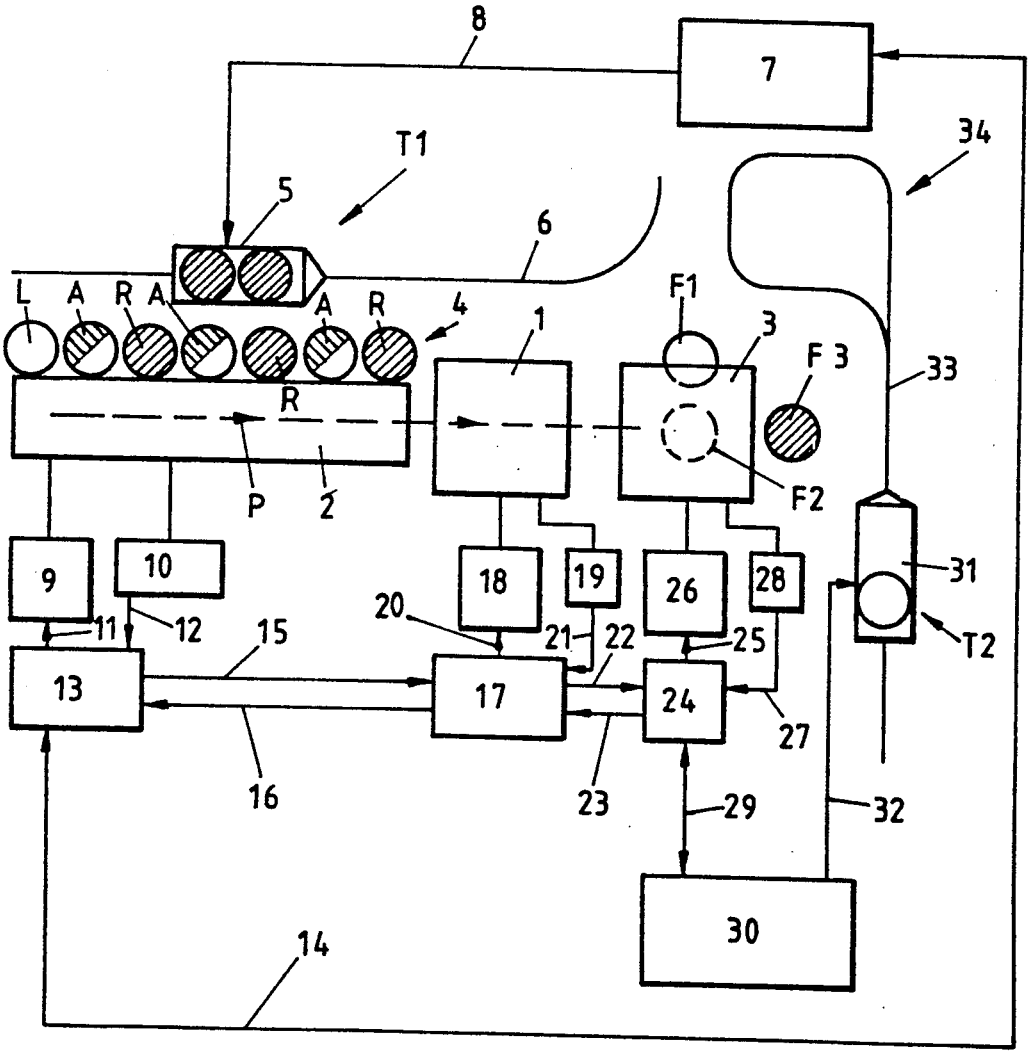
FIG. 1 is a schematic top view of textile processing machine with a feeding and delivery device and a conveying system.

FIG. 1 shows a textile processing machine, e.g. a drafting frame 1, which is provided with a drafting device not shown here. The feeding device is a feed lattice 2 and the delivery device is a sliver coiling 3. Along feed lattice 2 cans A, R are arranged for taking out slivers. A is the work can and R is the reserve can. The space taken up by cans A, R is generally termed as can frame 4. In said can frame 4, empty spaces may be provided for receiving cans by the conveying system. This improves the logistics of the conveying system, and therefore its effectiveness.

It is also possible to use more cans A, R and more empty spaces L than in the present example.

Directional arrow P shows the feeding and the direction of passage of the textile material before it arrives at the sliver coiling 3. Feed lattice 2 or can frame 4, respectively, are provided with a conveying system $T_1$ having a driverless conveying vehicle 5 which is guided via a guide line 6.

As can be seen in the drawing, presently two cans R are on the conveying vehicle 5. Said vehicle 5 is controlled by master computer 7. That is to say that said vehicle receives its order to move from the master computer 7 via a connection means 8. Said connection means may either occur wireless, via a connecting wire or a communication station. Drive 9 of feed lattice 2 as well as the sensing means 10 are displayed schematically.

Drive 9 is connected with the control unit 13 via a path 11 and sensing means 10 is connected via path 12 to said unit 13. Control unit 13 communicates via line 14 with the master computer 7 of the conveying system $T_1$.

Paths 15 and 16 allow the communication between control unit 17, drive unit 18, and drafting frame 1. The schematically displayed sensing means 19 of drafting frame 1 is connected with control unit 17 via path 21. The two connections 22 and 23 allow the communication between the control unit 17 and control unit 24 of sliver coiling 3. Control unit 24 is connected with the schematically displayed drive 26 via paths 25, and to sensing means 28 of sliver coiling 3 via path 27. Furthermore, there is a connection 29 between the control unit 24 of sliver coiling 3 and a master computer 30 of a further conveying system $T_2$. The master computer 30 communicates, via a line 32, with a conveying vehicle 31 which is guided via a guide line 33.

In the shown example, can $F_2$ is located in the filling station, whereas empty can $F_1$ is ready for following up. F3 indicates a filled can which has been ejected from sliver coiling 3 and which is ready for being taken up by the conveying vehicle 31.

Guide line 33 is provided with a terminal loop 34.

Figure 2:
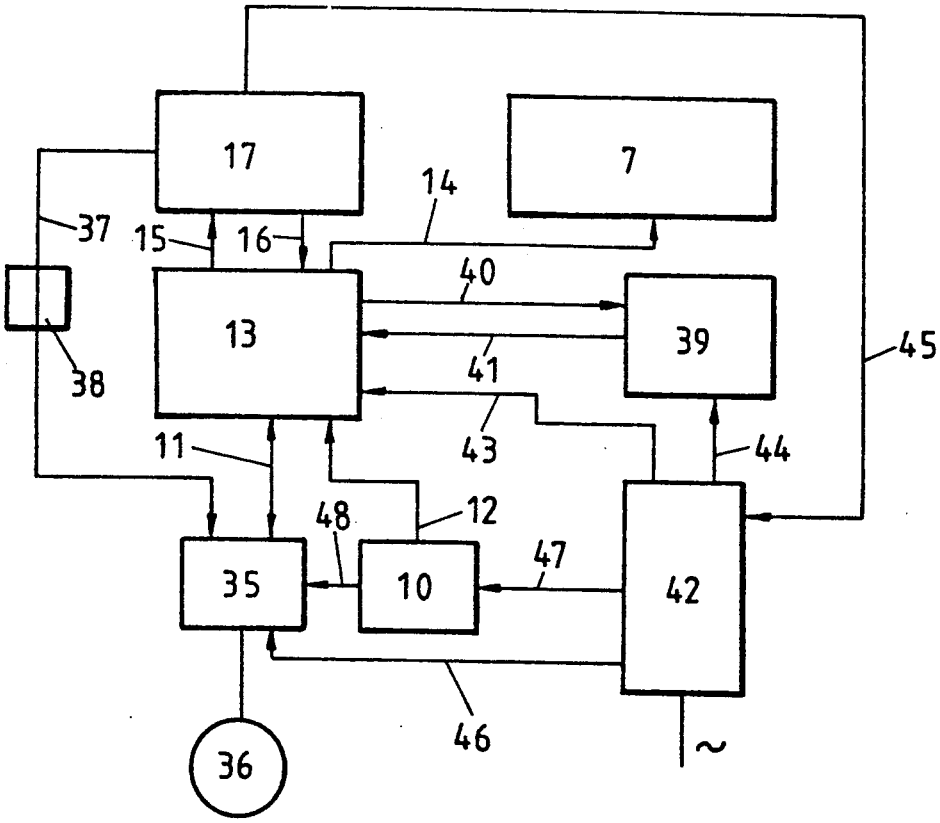
FIG. 2 is a schematic modular display for the drive and the control of a feeding device in accordance with FIG. 1.

FIG. 2 shows a more detailed display of the drive and control mechanism for feed lattice 2. Starting out from the control unit 13, a connection is made to the motor electronics 35 via path 11, said electronics controlling a motor 36. For reasons of clarity, FIG. 2 only displays one motor. Several motors 36, however, could nevertheless be applied, each of said motors having motor electronics 35. Between motor electronics 35 and the control unit 17 for the drafting frame, a line 37 is provided which contains an attenuating means 38. Via said line 37 the motor electronics 35 or the motor 36, respectively, receive a guiding signal which ensures synchronization between the feeding speed of the textile material and the processing speed. For the purpose of starting up motor 36 and therefore feeding device 2, said motor electronics are controlled via path 11 by control unit 13. Lines 40 and 41 provide the connection between the control unit 13 and the display and operating unit 39. A power supply unit 42 supplies electric power to the display and operating unit via line 44, to the control unit 13 via line 43, to the sensing device via line 47 and to the motor electronics 35 via line 46. In order to prevent faulty connections, power supply unit 42 is switched on via line 45 of control unit 17 of drafting frame 1. That means to say that the power supply unit is only activated upon switching on the control unit 17 or the drafting frame 1, respectively. By means of line 48 connected between sensing means 10 and the motor electronics 35 it is possible to directly influence the motor electronics for controlling the motor. This allows, in certain cases, reducing the reaction time for changing the motor speed, as the processing unit of control unit 13 is by-passed.

Figure 3:
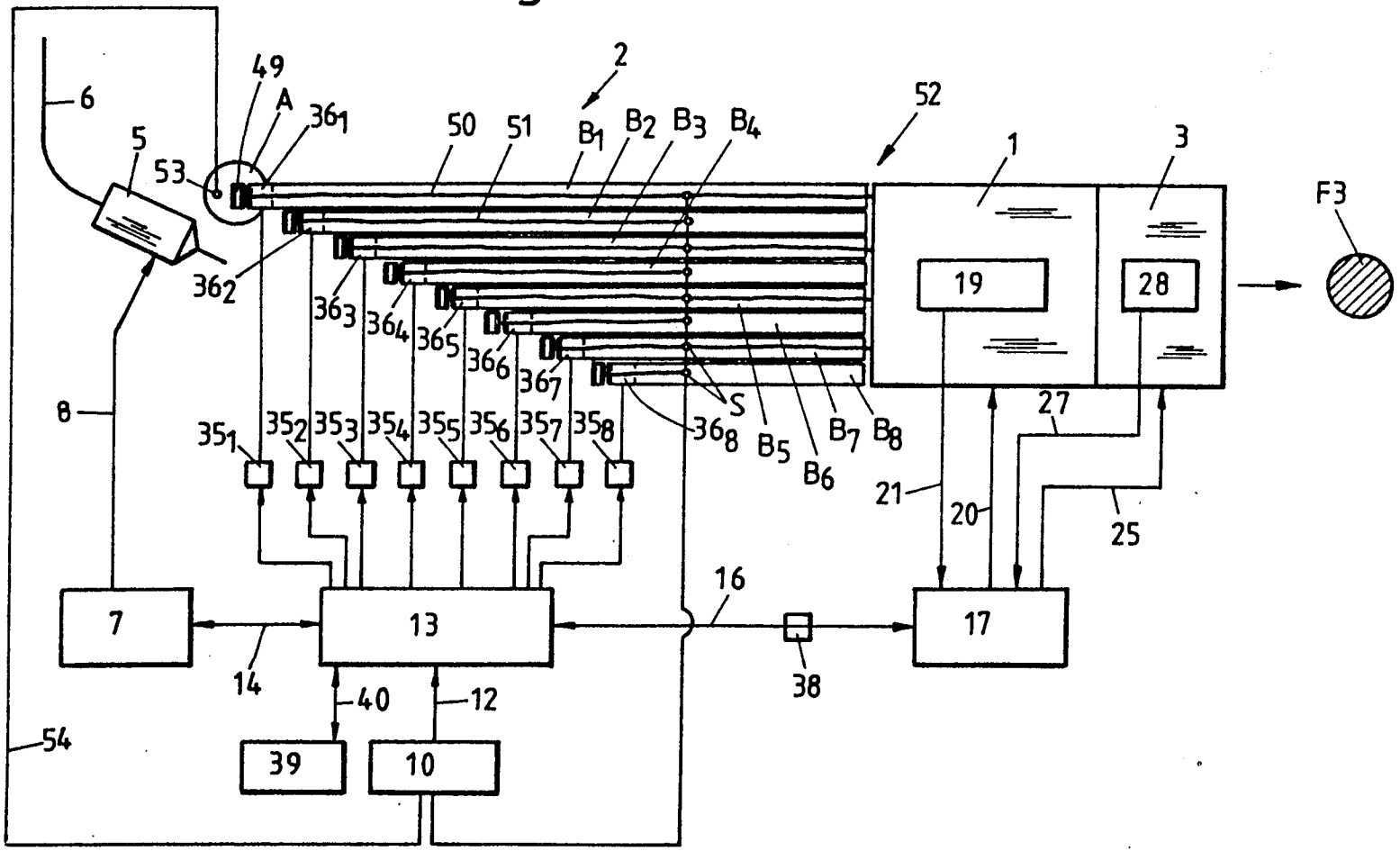
FIG. 3 is a schematic top view of an embodiment of the feeding device with individual conveyor belts.

FIG. 3 shows an embodiment of the invention, whereby a feed lattice is made up of a total of eight individual conveyor belts $B_1$ to $B_8$. Each conveyor belt $B_1$ to $B_8$ is arranged with a separate drive motor $36_1$ to $36_8$. Said drive motors $36_1$ to $36_8$ are to be found each above the calender positions over a can, whereby, for reasons of clarity, only one can A is displayed. The other seven cans are arranged accordingly. Within the revolving belts $B_1$ to $B_8$ swivelling pressure rollers 49 are arranged at each calender position. During the operation said rollers 49 are pressed in the direction of the respective conveyor belt $B_1$ to $B_8$ and thus enable the respective sliver to be drawn off by means of seizing between the conveyor belt and the pressure roller 49. As can be seen from the top view, only every second, i.e in the present example only four, slivers 50 are passed on to the delivery position 52 of drafting frame 1. The slivers 50 thus delivered are combined in said delivery position 52 to nonwoven material (not shown here)

before said slivers are fed to the drafting device of drafting frame 1. The other slivers, also referred to in such an operational condition as reserve slivers 51, are in a starting position below the row of sensors S and are fed upon malfunction of a sliver 50, i.e. one of the conveyor belts $B_1$ to $B_8$ has to be started up and hooked up via the respective motor 36. The supervision of the slivers or the sliver breakage may take place directly in the vicinity of the calender positions.

Conveying vehicle 5 with guide line 6 is only schematically outlined here. In this embodiment drafting frame 1 and the sliver coiling 3 are combined to a unit which is controlled via a control unit 17. Sensing means 19 of drafting frame 1 and the sensing means 28 of the sliver coiling 3 are connected via paths 21 or 27 with control unit 17. The respective drive units were not specifically outlined. The transmission of a guide signal from drafting frame 1 is made via control unit 17 and 13 to the individual control units $35_1$ to $35_8$ of motors $36_1$ to $36_8$. The path 16, which was provided for this purpose, comprises an attenuator means 38 for dampening short-wave signals.

Each can positioning area is provided with a can sensing means 53 which is connected with control unit 13 via a line 54, the sensing means 10, and path 12. For reasons of clarity, FIG. 3 only displays one sensing means 53. Said sensors 53 may, on the one hand, be used for ascertaining whether a can is present and, on the other hand, for verifying its contents. The signals thus received from the sensing means 53 are responsible for making the conveying system ready and for preparing the supply of a reserve sliver.

When starting up drafting frame 1 in accordance with FIG. 1, the slivers manually or automatically taken from the cans are applied to the calender position between the respective conveyor belt B and the respective pressure roller 49. The respective motors $36_1$ to $36_8$ are started up through the operating unit 39 and via control unit 13, thus bringing slivers 50, 51 into the predetermined position. The conveyor belts may be stopped for effecting and controlling a specific position of the respective beginning section of the sliver, e.g. by means of a row of sensors S. In such an event, for example, the beginning sections of the reserve slivers 51 may come to stop at the level of the row of sensors S, whereas the beginning sections of slivers 50 may be guided up to the delivery position 52 where said slivers are combined to form nonwoven material.

After such starting up, or placing of said eight slivers, the further insertion of slivers 50 into the subsequent drafting device or the insertion of the sliver emerging from the drafting device into the sliver coiling may be performed either manually or automatically.

During the operation, the motor speed of motors $36_1$ and $36_8$ is adjusted via path 16 to the control dynamics of the drafting device of drafting frame 1.

Upon failure of a sliver due to its breakage or the emptying of a can, the respective conveyor belt B is switched on following a message via the sensing means 10. This occurs in such a manner that the end of the sliver which is running out overlaps with the beginning section of the reserve sliver 51 which is started up. This requires precise sensory analysis as well as precise starting up of the respective conveyor belt.

The message concerning the failure of a sliver or the emptying of a can is transmitted by control unit 13 via line 14 to the master computer 7 of the conveying system $T_1$. This transmission also includes the position of the empty can's location, whereupon the master computer issues a specific conveying order to the conveying vehicle 5 for picking up and exchanging the respective can for a new and filled one. The display of a further conveying system $T_2$ was not made in FIG. 3. It could, however, be performed like the example in FIG. 1 has shown. The embodiment in accordance with FIG. 1 is distinguished from that of FIG. 3 in that the drafting frame 1 and the sliver coiling 3 each comprise an own control and drive unit which communicate with each other via the respective control units 17 and 24, respectively. In other respects the embodiment in accordance with FIG. 1 differs only very slightly from that of FIG. 3. In FIG. 3 the feed lattice 2 is shown in a special arrangement and is more finely structured. The additional conveying system $T_2$ in the embodiment in accordance with FIG. 1 is intended for conveying empty cans $F_1$ to the sliver coiling 3 and to carry off the full cans $F_3$ ejected from said sliver coiling 3. The control unit 30 of this conveying system $T_2$ is connected with control unit 24 of sliver coiling 3.

The shown embodiments relate to a drafting frame, whereby the proposal in accordance with the invention are, however, not only limited to such machines.

I claim:

1. An apparatus for processing textile material, comprising:

a processing machine, and a processing machine control unit associated with said processing machine;

a textile material delivery device, and a delivery device control unit associated with said delivery device, said delivery device for receiving textile material from said processing machine and depositing said textile material in storage cans;

a feed apparatus for automatically supplying textile material to said processing machine, and a feed control unit associated with said feed apparatus and operatively independent from said processing machine control unit for independently controlling the operation of said feed apparatus in a non-dependent relationship with said processing machine control unit whereby a continuous supply of textile material is supplied to said processing machine without said feed control unit being dependent upon external commands, said feed control unit being responsible for the initiation and operation of the continuous textile material feeding process; and a feed automatic conveying system for supplying cans of textile material to said feed apparatus, said feed automatic conveying system comprising a conveying vehicle guided by a guide line, and a feed conveying system control unit for controlling said conveying vehicle.

2. The apparatus as in claim 1, wherein said processing machine comprises a drafting frame and said delivery device comprises a sliver coiling for depositing sliver from said drafting frame into said storage cans.

3. The apparatus as in claim 1, wherein said feed control unit synchronizes the feeding sped of said feed apparatus with the processing speed of said processing machine.

4. The apparatus as in claim 3, further comprising attenuator means operatively disposed between said feed control unit and said processing machine control unit.

5. The apparatus as in claim 1, wherein said delivery device control unit is operative communication with said processing machine control unit.

6. The apparatus as in claim 5, wherein said delivery device control unit and said processing machine control unit are connected forming a single combined control unit.

7. The apparatus as in claim 1, further comprising a delivery automatic conveying system for supplying empty said storage cans to said delivery device and for removing said storage cans containing textile material from said delivery device, said delivery automatic conveying system comprising a conveying vehicle guided by a guide line.

8. The apparatus as in claim 7, further comprising a delivery conveying system control unit for controlling said delivery automatic conveying system, said delivery conveying system control unit in operative communication with said delivery device control unit.

9. The apparatus as in claim 1, wherein said feed control unit is in operative communication with said feed conveying system control unit for signaling said feed conveying system control unit to cause said conveying vehicle to delivery cans of textile material to said feed apparatus.

10. The apparatus as in claim 9, wherein said feed apparatus further comprises a feed lattice having a plurality of predetermined can positioning areas, said conveying vehicle delivery said cans to said can positioning areas, and at least one sensing device associated with each said can positioning area and in operative communication with said feed control unit, said sensing device configured to respond to at least one predetermined condition occurring at its associated said can positioning area and to send a corresponding signal to said feed control unit, whereby said feed control unit can signal said feed conveying system control unit to cause said conveying vehicle to delivery a can of textile material to said associated can positioning area.

11. The apparatus as in claim 10, wherein said sensing device comprises means for responding to the content of said cans present at said can positioning area and for generating and sending signals said feed control unit when the content level of said storage cans fails to a predetermined level.

12. The apparatus as in claim 10, wherein said sensing device comprises means for responding to the absence of a can from said associated can positioning area.

13. The apparatus as in claim 10, wherein at least one reserve can of textile material is provided at a first said can positioning area and at least one supply can of textile material is provided at a second said can positioning area for supplying textile material to said processing machine, whereby said sensing device associated with said second can positioning area signals said feed control unit to cause said feed apparatus to commence feeding textile material from said reserve can before the textile material from said supply can runs out so that a continuous supply of textile material is provided to said processing machine.

14. The apparatus as in claim 10, wherein said feed apparatus comprises a plurality of conveyor belts for supplying textile material to said processing machine from a plurality of cans, whereby at least one said conveyor is associated with each said can positioning area, said feed apparatus further comprising a plurality of drive motors whereby at least one said drive motor is associated with each said conveyor belt, said drive motors being controlled from said feed control unit.

15. The apparatus as in claim 1, wherein said drive motors comprise electric stepper motors.

16. The apparatus as in claim 1, wherein said drive motors comprise commutating brushless motors.

17. The apparatus as in claim 1, wherein the number of said conveyor belts is greater than the number of slivers of said textile material fed to said processing machine, whereby at least one said conveyor belt with an associated can of textile material are held in reserve.

18. The apparatus as in claim 17, wherein said conveyor belts are configured to operate in pairs as a first work conveyor belt for supplying textile material to said processing machine, and a second reserve conveyor belt for supplying textile material to said processing machine upon the occurrence of a predetermined condition of the working supply of textile material.

19. A textile machine for processing textile material with a control and drive unit and a feeding device for feeding textile material from storage means allocated to said feeding device, and a delivery device associated with said textile processing machine for delivering textile material from said textile processing machine to receiving storage means, said feeding device comprising:

an independent feed control and drive unit, said feed control and drive unit operatively connected with a feed operating and display unit, said feed operating and display unit arranged in a central operating and display unit of the textile processing machine;

at least one motor for driving conveying elements, said conveying elements for conveying textile material drawn from said storage means to said textile processing machine, said motor having associated electronic controls operatively connected with said feed and control drive unit; and sensing means for supervising the conveyance of textile material, said sensing means operatively connected to said feed control and drive unit.

20. The textile machine as in claim 19, further comprising a plurality of rotating conveyor belts for conveying textile material to said textile processing machine in the form of slivers, and at least one said motor and associated electronic controls being allocated to each said conveyor belt, all of said electronic controls of said motors being operatively connected with said feed control and drive unit.

21. The textile machine as in claim 20, wherein said motors comprise electric stepper motors.

22. The textile machine as in claim 20, wherein said motors comprise commutating brushless motors.

23. The textile machine as in claim 20, wherein said control unit of said textile processing machine is operatively connected with said motor control electronics of said motors via a connecting path for transmitting guiding signals.

24. The textile machine as in claim 23, further comprising attenuator means in said connecting path for filtering out shortwave signals.

* * * * *